US005991722A

United States Patent [19]

Thompson et al.

[11] Patent Number: 5,991,722

[45] Date of Patent: Nov. 23, 1999

[54] SPEECH SYNTHESIZER SYSTEM FOR USE WITH NAVIGATIONAL EQUIPMENT

[75] Inventors: George W. Thompson, Harwichport; Glenn R. Greenough, Dennis, both of Mass.

[73] Assignee: Vectra Corporation, Harwich, Mass.

[21] Appl. No.: 08/695,663

[22] Filed: Aug. 8, 1996

Related U.S. Application Data

[63] Continuation of application No. 08/144,667, Oct. 28, 1993, abandoned.

[51] Int. Cl.[6] ..... G10L 3/00

[52] U.S. Cl. ..... 704/258; 704/272

[58] Field of Search ..... 395/2.67, 2.79, 395/2.7, 2.76, 2.77, 2.81; 704/258, 270, 261, 267, 268, 272

[56] References Cited

U.S. PATENT DOCUMENTS 5,181,250 1/1993 Morgan et al. ..... 395/2.67
5,274,560 12/1993 LaRue ..... 364/444
5,321,819 6/1994 Szczepanek ..... 395/325

FOREIGN PATENT DOCUMENTS 057855 7/1979 Canada ..... G10L 1/08

*Primary Examiner*—Richemond Dorvil
*Attorney, Agent, or Firm*—Samuels, Gauthier & Stevens

[57] ABSTRACT

A speech synthesis system for receiving input information from navigational equipment and for producing selected audio output signals associated with the input information. The system includes a receiver for receiving input information from the navigational equipment, a temporary storage unit for storing at least a portion of the input information, a permanent storage unit for storing predetermined audio output information associated with portions of the input information, a control unit and an output signal generating unit. The control unit is in communication with the receiver and the temporary and permanent storage units. The control unit selects the predetermined audio output information within the permanent storage unit associated with portions of the input information. The output signal generating unit is in communication with the control unit for producing an output signal responsive to the predetermined audio output information.

9 Claims, 5 Drawing Sheets

SPEECH SYNTHESIZER SYSTEM FOR USE WITH NAVIGATIONAL EQUIPMENT

This is a continuation of application Ser. No. 08/144,667 filed on Oct. 28, 1993 now abandoned.

BACKGROUND OF THE INVENTION

The invention relates to speech processing systems for use with marine navigational equipment.

Present marine navigational equipment, such as LORANs, global positioning systems (GPS), satellite navigational systems (SATNAV), depth sounders, temperature gauges, and digital compasses etc., provide output information via displays and/or serial digital output signals.

Display outputs on navigational equipment require that a viewer be positioned to view the display when the navigational information is desired. This is not always possible, particularly when the one or more persons on the boat are each busy with other activities, such as pulling nets or lobster traps, or controlling the movement of the boat in adverse weather conditions.

Although attempts have been made to provide speech output from navigational equipment, such devices have been unsatisfactory either because the devices are slow and expensive, or because they are too limited and inflexible. Devices that speak or spell words or characters as they are received from an input string such as an allophone speech synthesis system, are not sufficiently fast and typically produce low quality speech. Devices that only repeat the same (or slightly varying) information, such as a depth detecting device that periodically outputs the sensed depth through an allophone speech synthesizer, are not sufficiently versatile. Devices that employ prerecordings of entire sentences (including all possible combinations of numbers) require a great deal of memory and are consequently either very slow or prohibitively expensive.

It is an object of the invention to provide a flexible yet inexpensive high quality speech synthesis system for providing speech synthesized output of navigational information from a variety of equipment.

It is a further object of the invention to provide a speech synthesis system that utilizes a limited but large number of predefined words or phrases, and provides realistic human speech at a natural speed.

SUMMARY OF THE INVENTION

The system of the invention is capable of receiving navigational information from a host of navigational equipment, and may be programmed to provide high quality speech synthesis of all or any subset of the received information in any desired order. Selected data is dynamically matched to prerecorded digitized words and phrases.

The system is flexible yet inexpensive due to the fact that the system incorporates both temporary and permanent memory storage wherein phrase codes associated with phrases to be spoken are stored in the temporary memory. The system may also include memory enhancement techniques such as storing compressed phrases in the permanent memory, and expanding the phrases at the output stage. Other memory enhancement techniques include disabling devices other than the permanent memory during permanent memory access to permit access to the full 16 bit range of addressable memory, and/or using port lines in addition to the data/address bus for accessing a larger sized permanent memory.

DETAILED DESCRIPTION OF THE INVENTION

Figure 1:
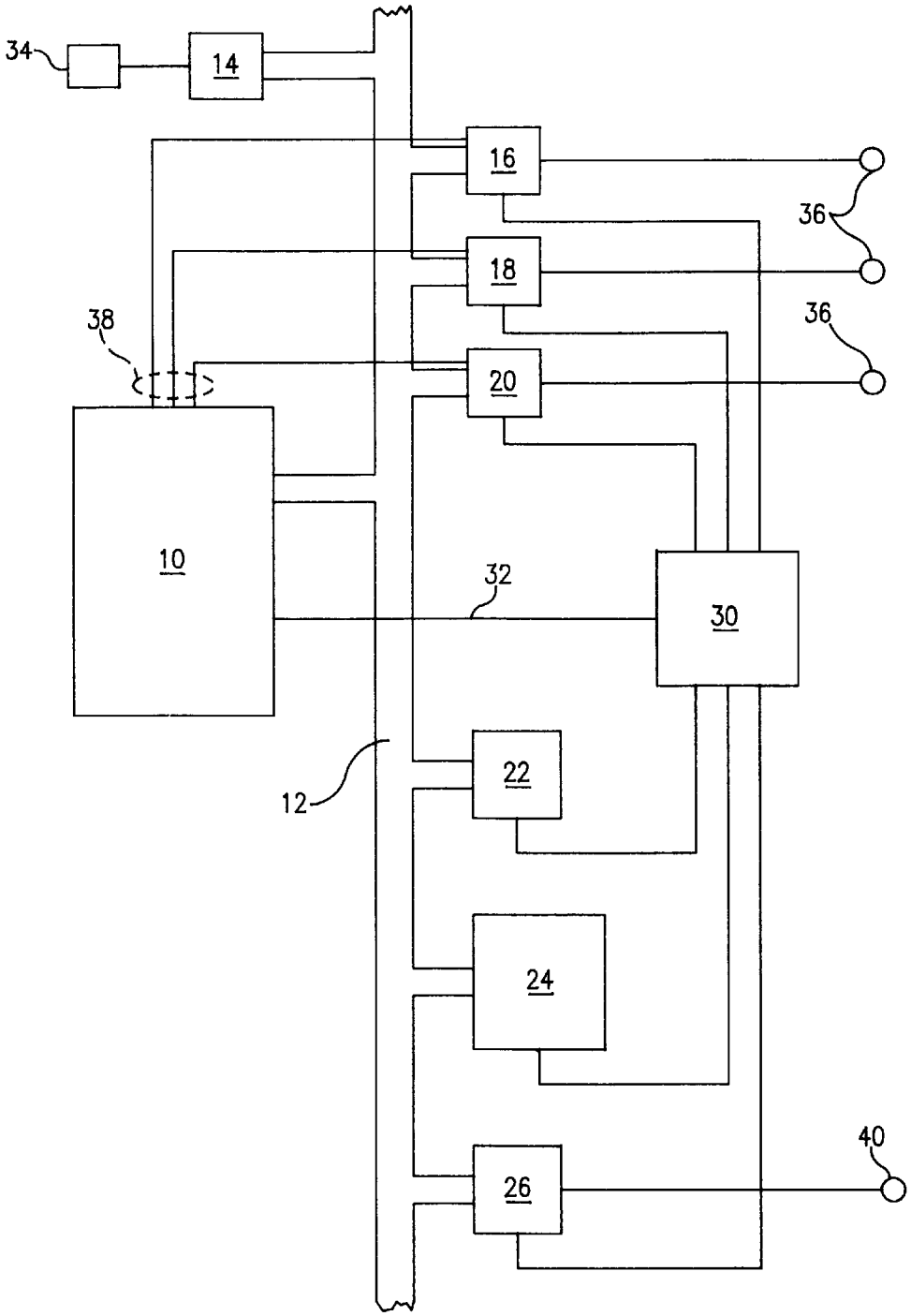
FIG. 1 shows a diagrammatic representation of a system of the invention.

As shown in FIG. 1, a system of the invention includes a central processing unit (CPU) 10, connected via a data/address bus 12 to a keyboard interface port 14, three universal asynchronous receiver/transmitters (UARTs) 16, 18 and 20, a random access memory (RAM) unit 22, a read only memory (ROM) unit 24, and a speech generating unit 26 which includes a digital to analog (D/A) converter. The bus 12 includes a 16 bit address bus and an 8 bit data bus. The CPU 10 is also connected to an address decoder & memory management unit (ADMM) 30 through communication lines 32. The ADMM unit 30 includes a versatile interface adapter and several programmable logic devices. A keyboard 34 is connected to the keyboard interface port 14 for programming the system.

In the present embodiment the keyboard 34 includes dual function and single function pushbuttons. The dual function pushbuttons provide for dual functions with the cooperation of an "upper" key and a "lower" key that accesses the "upper" and "lower" functions associated with each key. For example, a "DEPTH/HEADING" key is provided which includes an upper DEPTH key command and a lower HEADING key command. Other keys include up and down arrows for entering numerical information such as the volume level and the time between reports. The order of reporting the selected types of data is the order in which they are selected through the keyboard 34. The program provides speaker output signals to prompt the user and to confirm selections as they are made. The system should also provide immediate feedback regarding current settings upon request. The keyboard 34 may be back-lighted and should include a waterproof membrane.

Input signals from the navigational equipment (not shown) are received by the UART ports 16, 18 and 20 through connectors 36. The UART ports are also connected to the interrupt lines 38 on the CPU 10. The speech output signal is generated by the speech generating unit 26 and delivered to the connector 40 or directly to an internal speaker. In operation, one or more of the UART ports is connected to navigational equipment whose serial digital output signals conform to NMEA 0183 standard communications protocol. The connector 40 is in communication with a speaker or headset system (not shown).

Figure 2:
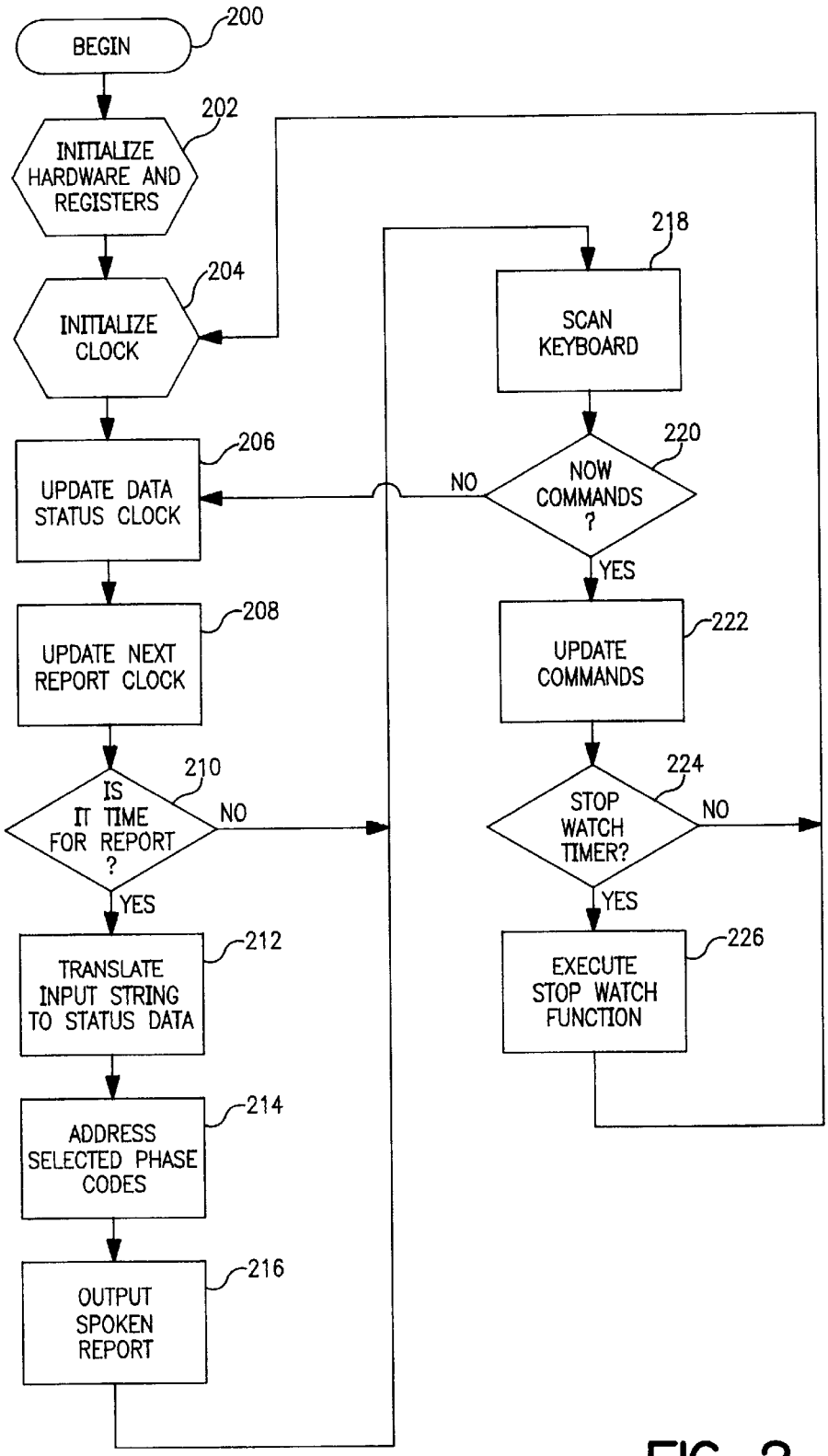
FIG. 2 shows a process flow diagram of the operational steps of the system of the invention shown in FIG. 1.

The operational program for the system of the invention includes an endless loop routine as shown in FIG. 2. Generally, the program causes speech output signals to be sent to the speech generating unit at appropriate times, and the program continuously scans the keyboard input port 14 for new commands. The commands include information regarding the type of data to be reported and the frequency of the reports.

Interrupt routines are automatically executed by the CPU 10 when a new input string is received at a UART port. The interrupt routines cause each newly received input string to be stored in a preliminary buffer as it is received, and later to be copied into one of several input buffers if the data types in the input string are valid data types. There is one input buffer for each type of input string. When the end of the input string is detected the string is copied into the appropriate input buffer for the string type. Flags are maintained to identify invalid string types. A clock is reset when an input string is received and verified to indicate that the string is currently valid. When a report is required, a set of priorities are used to determine which string to use if the same type of information has more than one potential source. If necessary data is missing but can be derived from available data, the required data is calculated by the CPU 10. Error codes are generated for missing or improperly received input data. The input buffers are accessed by the main program as discussed below.

Input strings are typically provided every 1 to 4 seconds. In accordance with NMEA 0183 standard communications protocol, the input strings begin with a "$" character followed by a five character address field that identifies the input string type and the type of navigational equipment from which the input string has come. The input strings further include one or more data fields (separated by commas), error detection information (such as checksum information) following a "*" character, and terminate with a carriage return character <CR> and/or a line feed character <LF>.

For example, the following input string includes information regarding a heading measured in degrees true and magnetic, and a speed in knots and km/hr. A checksum is also provided for error checking.

$LCVTG,327.,T,342.,M,12.9,N,37.6K*75<CR><LF>

The following input string includes information regarding water temperature in degrees celsius, and includes no checksum.

$SDMTW,27.5,C<CR><LF>

By way of illustration, the output generated by the system of the invention could produce the following sequence of phrases if water temperature is a selected output: "water temperature is", "two", "seven", "point", "five", "degrees", "celsius". Certain phrases (especially numbers) are prerecorded with specific inflections and timing of phrases to allow any sequence of playback to sound like natural speech. Each spoken report consists of a beginning phrase, one or more digits, and an ending phrase containing the units of measure. Alarm statements may be included as needed.

The present system accepts input strings of up to 79 characters in length. In the present system the serial data transmission occurs at 4800 baud, with 8 data bits per character, no parity, and one stop bit. When transmitting ASCII characters the last data bit (number 7) is set to zero. Additional types of error checking include field counting and completeness, include checking for abnormalities in the input string structure, proper timing and updates, and include source device error reporting.

As shown in FIG. 2, the program begins (step 200) by initializing the hardware and registers (step 202) as well as the clocks and timers (step 204). The data status clocks (step 206) and next report clock (step 208) are then updated as required. The data status clocks are maintained (one for each data type) to record the amount of time that has passed since each data type was last updated. Data that is not updated frequently is flagged as invalid to prevent it from being reported. The next report clock controls the interval between reports, which involves monitoring the timing for both data reports as desired and alarm reports as required. A decision is then made whether the present time is greater than or equal to the report time. If not, then the program proceeds to step 218 and newly entered commands, if any, are input from the keyboard port.

If the time is appropriate (step 212) for a report to be sent to the speech generating unit, then the program updates the RAM memory 22 with all of the new data stored in the input buffers (step 214). Specifically, the input string is parsed and the input data is stored in a data table in RAM 22. For example, if the input data includes speed and heading information then the speed and heading data in the data table are updated. The data table includes all current data regardless of the data types that are presently selected for output.

The program then locates the phrase codes in the ROM memory 24 associated with the data to be spoken (step 214). For example, if the selected output data is depth and heading, then the phrase codes that are located are the codes for the individual digits of the selected data (e.g., "two" "zero" "point" "five" for 20.5) as well as the words "depth" and "heading" themselves. The appropriate units may also be made available and provided accordingly. The phrase codes are arraigned in the appropriate order and delivered to the speech generating unit 26 (step 216).

Each phrase is stored as a digitized recording in the ROM memory 24. An individual phrase is identified by its first and last address, and each phrase has a pair of addresses associated with it in a look up table. A separate table in RAM has a list of phrase codes that are selected for output. During output the first and last addresses are accessed for the initial phrase to be reported. Data within the address range is sent at a predetermined rate to the speech generating unit 26. When the datum for the last address is sent, the next address range is determined for the next phrase code. After the data for the final phrase code is sent the speech routine terminates.

Sentences consist of beginning phrases such as "Depth is . . . ", middle phrases such as "five" and ending phrases such as "feet". The phrases are spoken without gaps between the phrases. This provides an output signal that sounds like natural speech, as if the sentence had been recorded as a single recording. The speech output is uninterrupted due to the memory management of the system of the invention.

Figure 3:
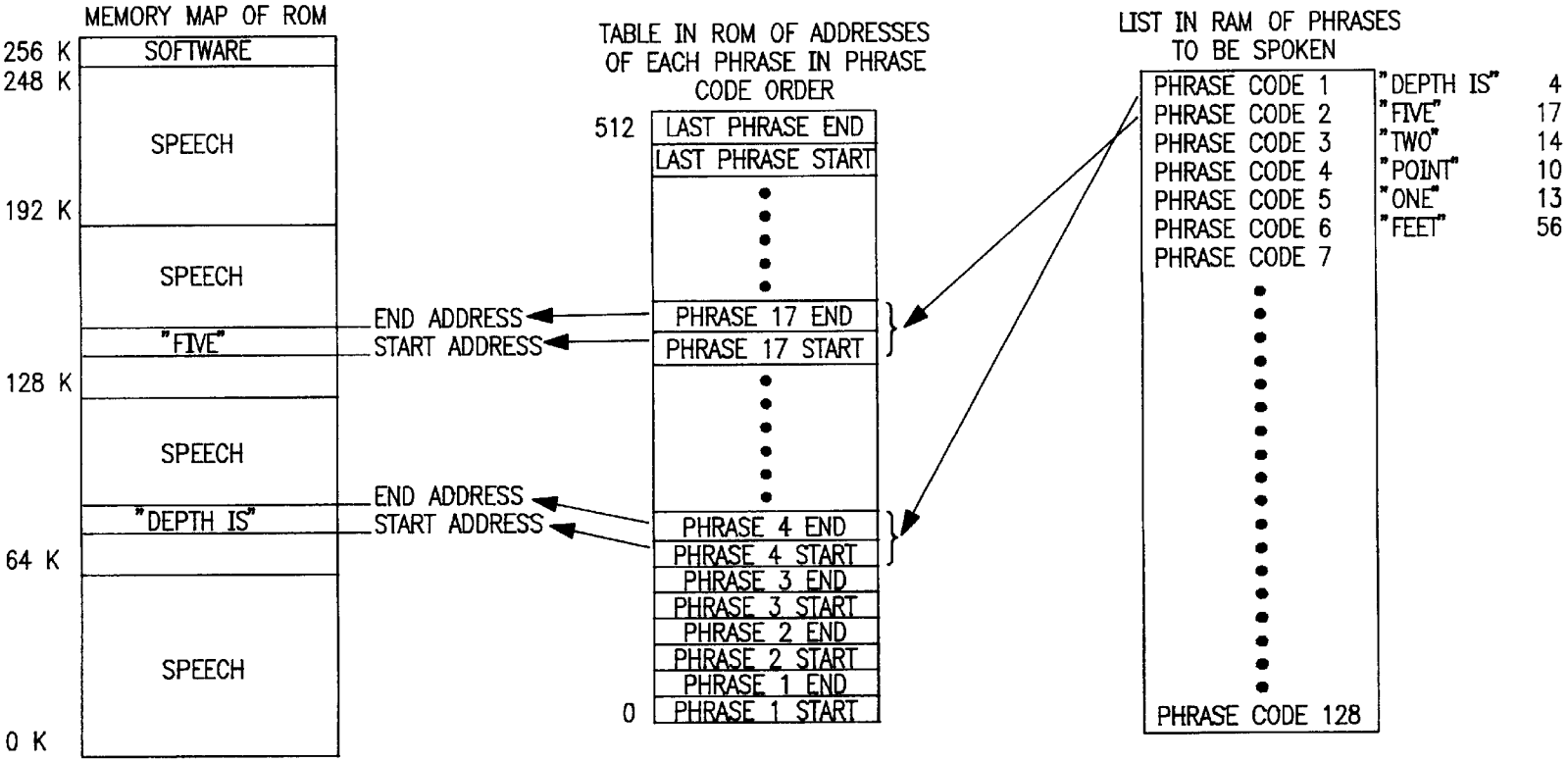
FIG. 3 shows the memory accessing scheme of the speech generating process.

Specifically, and with reference to FIG. 3, each phrase has a code associated with the phrase. At the appropriate times for producing an output signal, a script is generated that consists of a list of phrase codes. The script is based on inputs from the user as well as navigation equipment. The script is a fixed length and is filled with null phrases in the event that the script is shorter than the maximum. A null phrase is a silence for a duration of 1/2000 seconds. For each phrase code, a table in ROM includes a pair of addresses that specify the recorded data for each phrase. The digitized recording for each phrase is stored in another portion of the ROM.

To convert a script to speech, the address pair for the first phrase code is accessed in the ROM table and copied to a pair of registers. The datum at the first address is read from the ROM and written to the D/A converter. The address in the first register is incremented and compared with the second register. If the addresses are the same then the first phrase is finished. If not, then the datum at the next address is read from the ROM and transferred to the D/A converter in the next clock cycle. The CPU and the D/A converter are synchronized by the clock. The CPU continues until the last address is reached. Prior to the next subsequent cycle of the D/A converter, the address pair corresponding to the next phrase is accessed and copied into the registered pair. Data transfer then continues as described above until the last phrase is sent to the D/A converter at which point the speech terminates.

The phrases stored in the ROM 24 in the present embodiment are stored in a compressed format to reduce memory requirements and increase access speed. The compressed format involves adaptive differential pulse code modulation ("ADPCM") which reduces memory requirements generally by digitally storing the differences between successive voltage values at each sampling interval rather than storing the voltage values themselves. The speech generating unit 26 recreates the original speech information by expanding the compressed phrase data to create sound signals for phrases such as "Depth is". The phrase code data is expanded by generating a varying voltage value that is adjusted responsive to the recorded differences at the same rate at which the measurements were originally sampled. A sample rate of 8000 samples per second is used in the present system. The memory requirements are based on the speed with which the numbers are generated as well as the number of recorded digits for each number. In this case there are 8 bits per sample and 8000 samples per second, requiring 64000 bits of memory per second of speech. The ADPCM values may be stored using four bits each instead of the conventional eight yet include all of the required information thus reducing the memory requirements in the present embodiment by a factor of two.

If no new commands are entered into the system via the keyboard 34 connected to the keyboard port 14 (step 220), then the program returns to step 206 and repeats the above procedure. If new commands are entered through the keyboard 34, then the command set is updated accordingly (step 222). If the new command is a request to run a stop watch timer program (which, for example, might be helpful to a sailboat racer) (step 224), then the program proceeds to execute a stop watch timer routine (step 226). The stop watch timer routine in the present embodiment permits the running of 5 or 10 minute timers with audio output concerning time remaining at programmed intervals. All functions (except the interrupt routines) are suspended during the operation of the timer. At the termination of the stop watch timer program (or if the new command was not a request for the timer routine), the program returns to step 204 and repeats the above.

The operational speed and sound quality of the present system are enhanced by techniques that permit a larger size of ROM memory 24 to be accessed in short amounts of time. In addition to the use of ADPCM compressed phrase data stored in the ROM 24, the present system also permits full access to an increased size of ROM memory as follows.

First, the ADMM unit 30 (which communicates with each of the bus devices and controls the clock timing in cooperation with the CPU 10) is employed to increase the effective address range of the CPU 10. The ADMM 30 includes two ports which cooperate with communication lines 32 for passing data to and from the CPU 10, thereby increasing the overall address range of the CPU 10 by a factor of four. A two bit number is sent along lines 32 that specifies which of four 64k blocks of ROM memory 24 are to be accessed. At the beginning of successive phrases, the block number of the next phrase is written to the port. No data for a single phrase crosses block boundaries. This enables the ROM 24 to be four times the size normally addressable by a 16 bit address bus and further enhances the memory/speed capabilities of the system.

The program software is located in the last block at the upper end of the address range in the ROM memory 24. The ADMM 30 is signaled by the CPU 10 that a software access is occurring. The ADMM 30 then selects the upper block of ROM memory so that the CPU 10 may read the desired datum of software regardless of which block has been preselected by the port bits. This allows the CPU 10 to execute software which is in one block to access speech data from any block.

Second, the ADMM unit 30 is capable of temporarily disabling each of the bus devices from accessing the data/address bus. This permits the ROM memory to be addressable throughout the entire 16 bit range. Since the program code also resides in the ROM memory 24, the ADMM 30 must distinguish between phrase data accesses and program instructions. An address decoder reads the upper three address lines and determines which bus device is being accessed. The address decoder sends enable signals to the appropriate bus devices during a data transfer cycle. For example, when the CPU 10 begins to access the ROM 24, a signal is sent to the ADMM 30 to temporarily disable each of the other devices. To ensure proper timing, the number of machine cycles to be executed (e.g., 5) prior to disabling the other devices should be known. At the end of the phrase data access, the signal on the additional communication line is switched off so that the CPU 10 and devices may resume normal bus communication.

Figure 4:
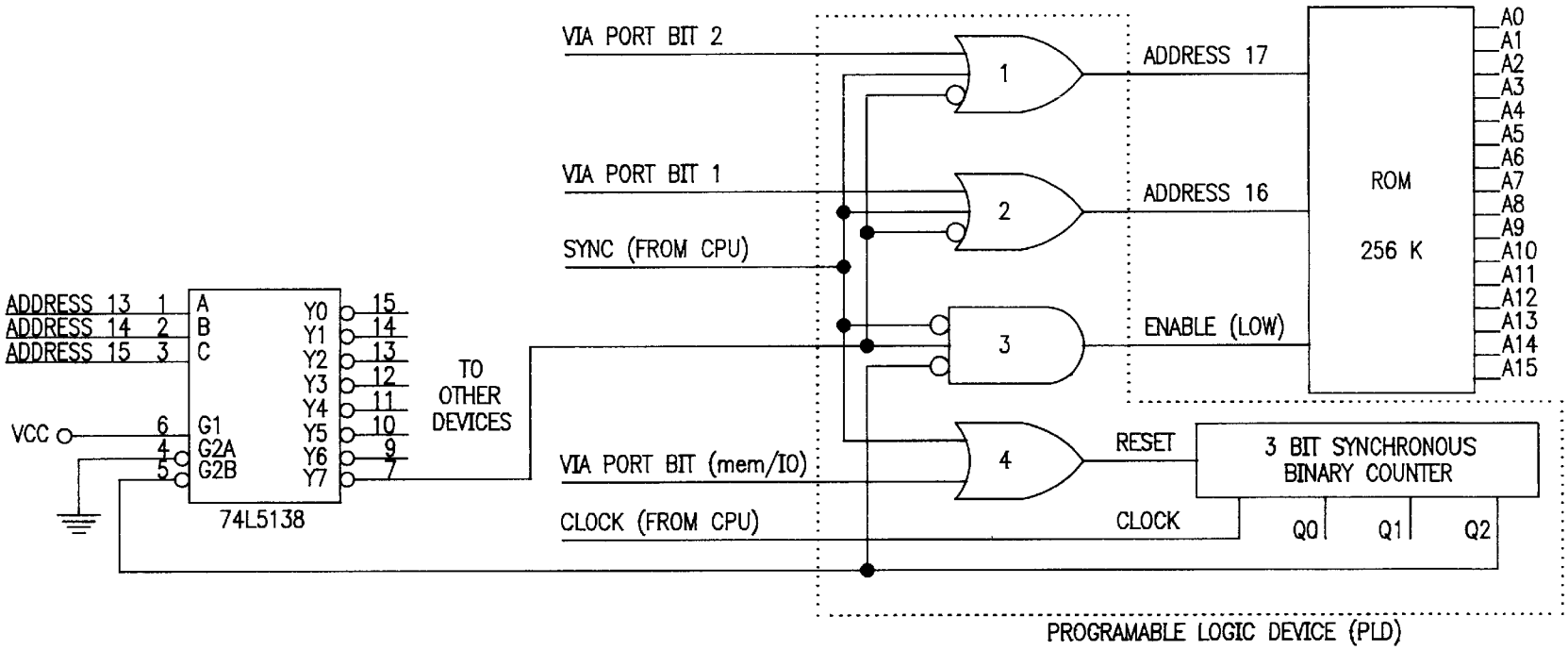
FIG. 4 shows a circuit diagram of the memory management system of the invention.

Specifically, and as shown in FIG. 4, the ADMM 30 comprises a TTL address decoder (74LS138), a PLD and a portion of a versatile interface adapter (VIA). The address decoder decodes the upper three address lines from the CPU into eight address ranges, selectively enabling the hardware devices, the RAM and the portion of the ROM that includes the system software.

Figure 5:
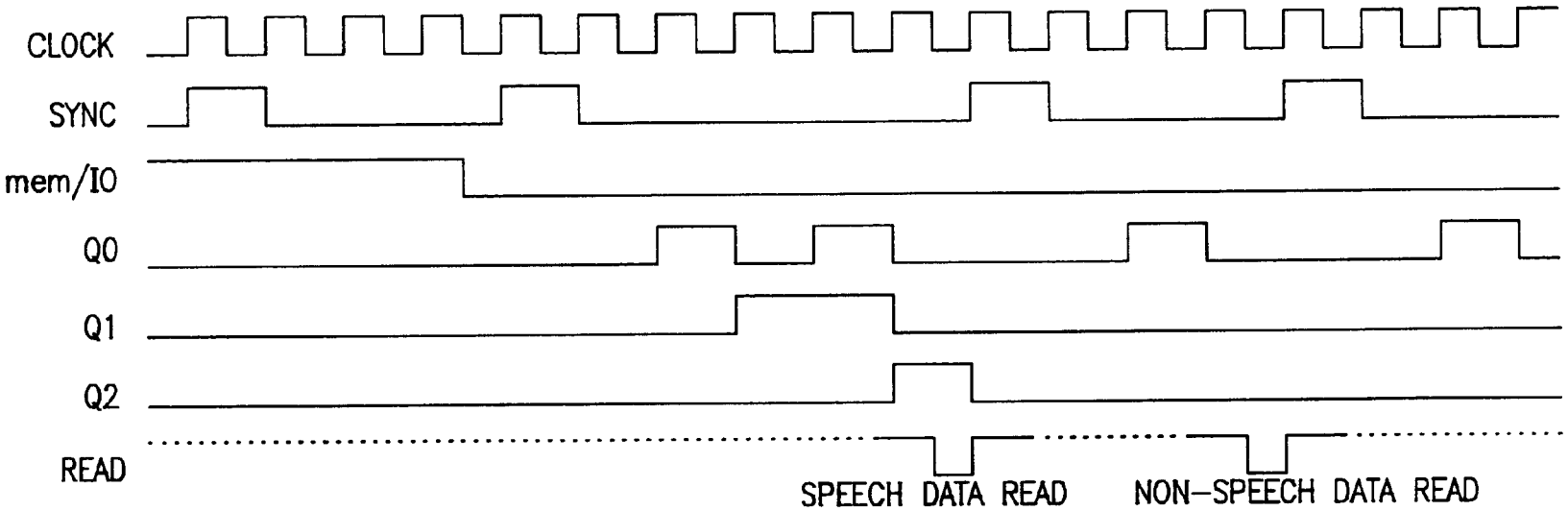
FIG. 5 shows a timing diagram illustrative of the timing sequence associated with the memory management system of the invention.

As shown in FIG. 5 and with reference to the circuit shown in FIG. 4, during normal operation, the mem/IO line is high, forcing the counter to be reset. This enables the address decoder and allows the ROM to be enabled only when the upper eighth of the normal address range is being accessed. When the ROM is being accessed, the upper two address lines of the ROM are forced high by gates 1 & 2, so that all normal accesses are in the upper fourth of the ROM which is where all the non-speech data and software resides.

The upper two bits of the 18 bit speech data address are preloaded into the VIA port. This specifies which of the four ranges the speech data in ROM is to be read. Then, the mem/IO line is brought low. This allows the counter to operate. The counter is reset on every software read, yet counts between cycles. As long as a short (less than five machine cycles) instruction is being executed, the counter output remains low and the ADMM operates normally as described above. The instruction used to read a speech datum, however, is a six cycle instruction. When a speech datum is read, the counter reaches a high output on the last cycle of the instruction, when the CPU is reading the speech datum. A high on the counter causes the address decoder to be disabled, which disables all addressable devices except the ROM. Gate 3 of the PLD forces the ROM to be enabled during this cycle. Gates 1 & 2 allow the upper two addresses to be passed from the VIA port to the ROM. On the beginning of the next instruction, the SYNC line goes high, forcing the ADMM back into normal mode. The mem/IO line is returned to high using short instructions to ensure normal operation until the next speech datum is needed.

The ADMM thus allows the speech data to overlap the addresses of the peripheral devices of DATAVOX. It also allows the CPU to read a ROM that is four times larger than the CPU's address range.

The components of the system are contained within corrosion and water resistant durable polycarbonate sealed enclosures which also shield against electromagnetic (e.g., radio frequency) interference. All exposed metal components are either stainless steel or painted with non-glare acrylic enamel in accordance with MIL SPEC # STD-489-527-529 for maximum corrosion resistance.

In alternative embodiments connections may be provided for connecting the system to VHF radio, intercom or audio entertainment systems. In this situation, the entertainment sounds are muted while a report is being provided.

We claim:

1. A speech synthesis system for receiving periodically updated serial variable data input information from navigational equipment and for producing selected audio output signals embodying said input information in speech format which comprises:

means for receiving the periodically updated serial data input information from said equipment;

means for storing temporarily at least a portion of said input information;

means for storing permanently as redundant whole words and phrases predetermined audio output information corresponding with said input information;

control means in communication with the means for temporarily storing the input data and the means for storing permanently the output information, for selecting and extracting the input data and for selecting and combining said predetermined audio output information of said redundant whole words and phrases with said selected and extracted input data to form a script of a message output; and output signal generating means in communication with said control means for producing an output signal of a smooth combination of spoken words corresponding to the script.

2. A system as claimed in claim 1 wherein the control means communicates with the means for temporarily storing input data and the means for storing permanently the output information and the output signal generating means via a data/address bus, and said output signal generating means may be temporarily disabled to maximize the amount of addressable memory in the means for storing permanently the audio output information.

3. The system as claimed in claim 1 wherein said control means is in parallel communication with the means for storing permanently the output information and said means for storing the output information is partitioned into at least two addressable data storage areas, and said system further comprises a memory management means in communication with said control means and said means for permanently storing the output information for selecting an area of said means for permanently storing the output information to be addressed by said control means via said parallel communication.

4. A system as claimed in claim 1 wherein said predetermined audio output information is stored within said means for permanently storing said output information in a compressed format and wherein said output signal generating means further includes expanding means for expanding the output information.

5. A system as claimed in claim 1 wherein said predetermined output information is stored within said means for storing permanently the output information in an adaptive differential pulse code modulation compressed format, and wherein said output signal generating means further comprises expanding means for expanding the output information.

6. A system as claimed in claim 1 wherein the control means includes interrupt ports and associated interrupt subroutines and wherein said means for receiving is in communication with said interrupt ports.

7. A system as claimed in claim 1 wherein the system further comprises a keyboard in communication with said control means for entering information into the control means regarding the identification of selected audio output signals to be generated by the output signal generating means.

8. A system as claimed in claim 1 wherein certain information stored within said temporary storage means is generated by said control means responsive to other information within said temporary storage means.

9. A speech synthesis system for receiving periodically updated serial variable data input information from navigational equipment and for producing selected audio output signals embodying said input information in speech format which comprises:

means for receiving the periodically updated serial data input information from said equipment;

means for storing temporarily at least a portion of said input information;

means for storing permanently as redundant whole words and phrases predetermined compressed audio output information corresponding with said input information;

control means in communication via a data/address bus, with the means for temporarily storing the input data and the means for storing permanently the output information for selecting and extracting the input data and for selecting and combining the predetermined audio output information of said redundant whole words and phrases with said selected and extracted input data to form a script of a message output and wherein the bus can be temporarily disabled to maximize the amount of addressable permanent memory;

memory management means in communication with said control means and the means for storing permanently the output information for selecting an area of said means for storing permanently to be addressed by said control means; and output signal generating means in communication with said control means for expanding said compressed audio output information and for producing an output signal of a smooth combination of spoken words corresponding to the script.

* * * * *